US005382033A

United States Patent [19]

Cheu

[11] Patent Number: 5,382,033

[45] Date of Patent: Jan. 17, 1995

[54] STRUCTURE OF BABY WALKER

[76] Inventor: Tseng-Fan Cheu, No. 24, Shing Shye Street, Hsinchu City, Taiwan, Prov. of China

[21] Appl. No.: 130,913

[22] Filed: Oct. 4, 1993

[51] Int. Cl.[6] ..... B62B 9/00

[52] U.S. Cl. ..... 280/87.051; 305/52; 482/54

[58] Field of Search ..... 280/87.051, 87.041, 280/87.04, 87.01; 482/68, 69, 54; 305/39, 52

[56] References Cited

U.S. PATENT DOCUMENTS 4,066,257 1/1978 Moller ..... 482/54
4,822,030 4/1989 Cone ..... 280/87.051
5,080,383 1/1992 Hsieh ..... 280/87.051

FOREIGN PATENT DOCUMENTS 467568 4/1914 France ..... 482/54
734490 10/1932 France ..... 482/54

*Primary Examiner*—Richard M. Camby
*Attorney, Agent, or Firm*—Varndell Legal Group

[57] ABSTRACT

A baby walker comprised of a movable base, and a seat supported on the movable base by a folding frame, the movable base comprised of a track formed of parallel rollers and endless belt mounted around the parallel rollers, whereby the baby walker is moved forward or backward as the baby supported on the seat pushes the legs against the track.

2 Claims, 5 Drawing Sheets

STRUCTURE OF BABY WALKER

BACKGROUND AND SUMMARY OF THE INVENTION

The present invention relates to a baby walker designed to stably support a child learning to walk.

Various baby walkers have been desclosed, and have appeared on the market. These baby walkers are commonly supported on wheels or casters. As the child pushes the legs against the ground, the wheels or casters are turned to move the baby walker forward or backward. While walking, the child's legs may be jammed in the wheels or casters easily. Therefore, conventional baby walkers are not safety in use. Further, wires and hairs may be adhered to the axles of the wheels or casters to affect the rotation of the wheels or casters.

The present invention has been accomplished to provide a track type moving base for a baby walker so that the child's legs will not be jammed while the child is supported on the baby walker to learn walking. The moving base is made in the form of a track comprised of a series of parallel rollers, and an endless belt mounted around the rollers. Gears are mounted on the first and last rollers on two opposite ends and respectively engaged with parallel teeth on the inside wall of the endless belt, and the endless belt is turned around the rollers to move the baby walker forward or backward as the child pushes the legs against the endless belt.

DETAILED DESCRIPTION OF THE PREFERRED EMBODIMENT

Figure 1:
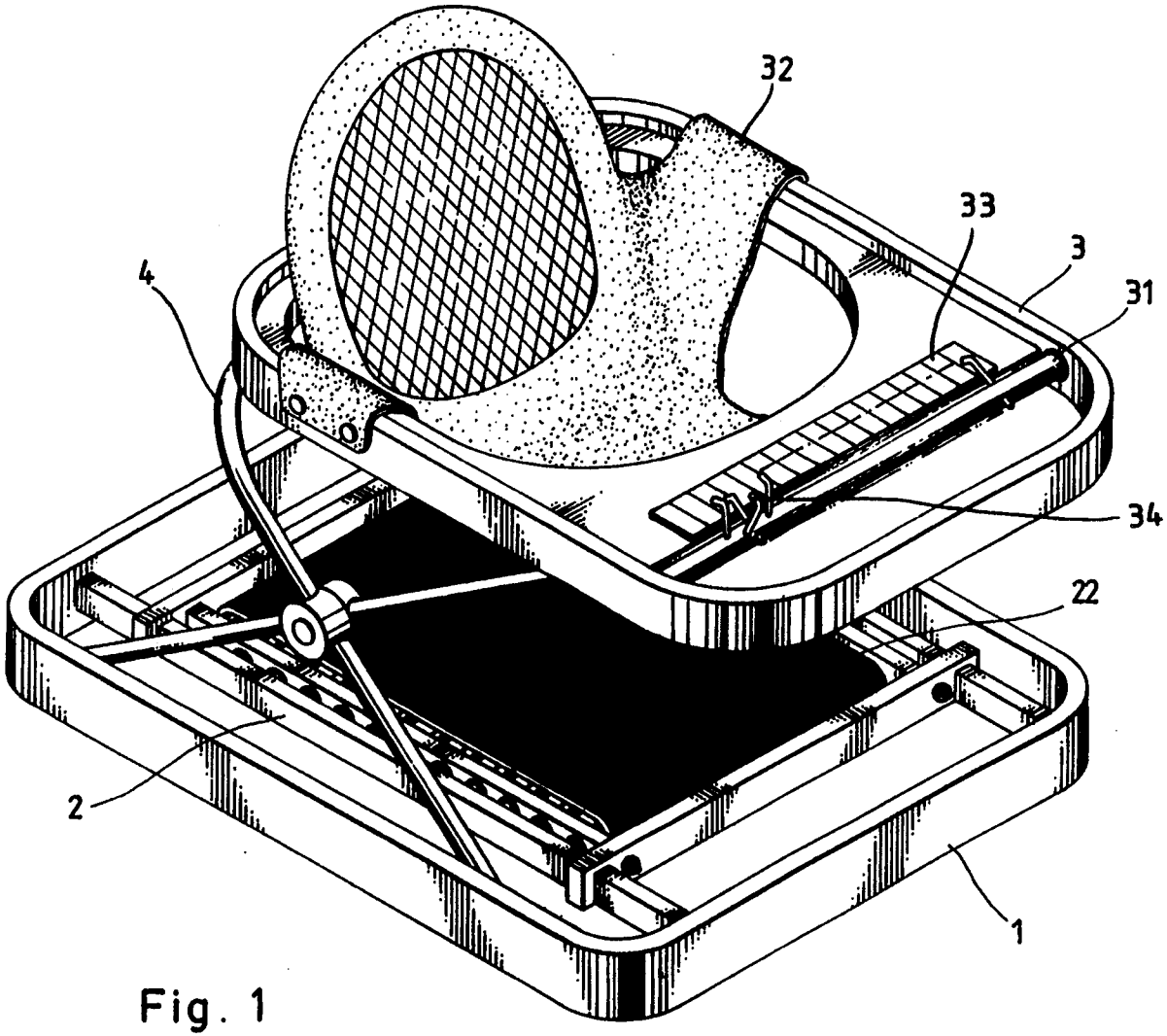
FIG. 1 is an elevational view of a baby walker according to the present invention.
Figure 2:
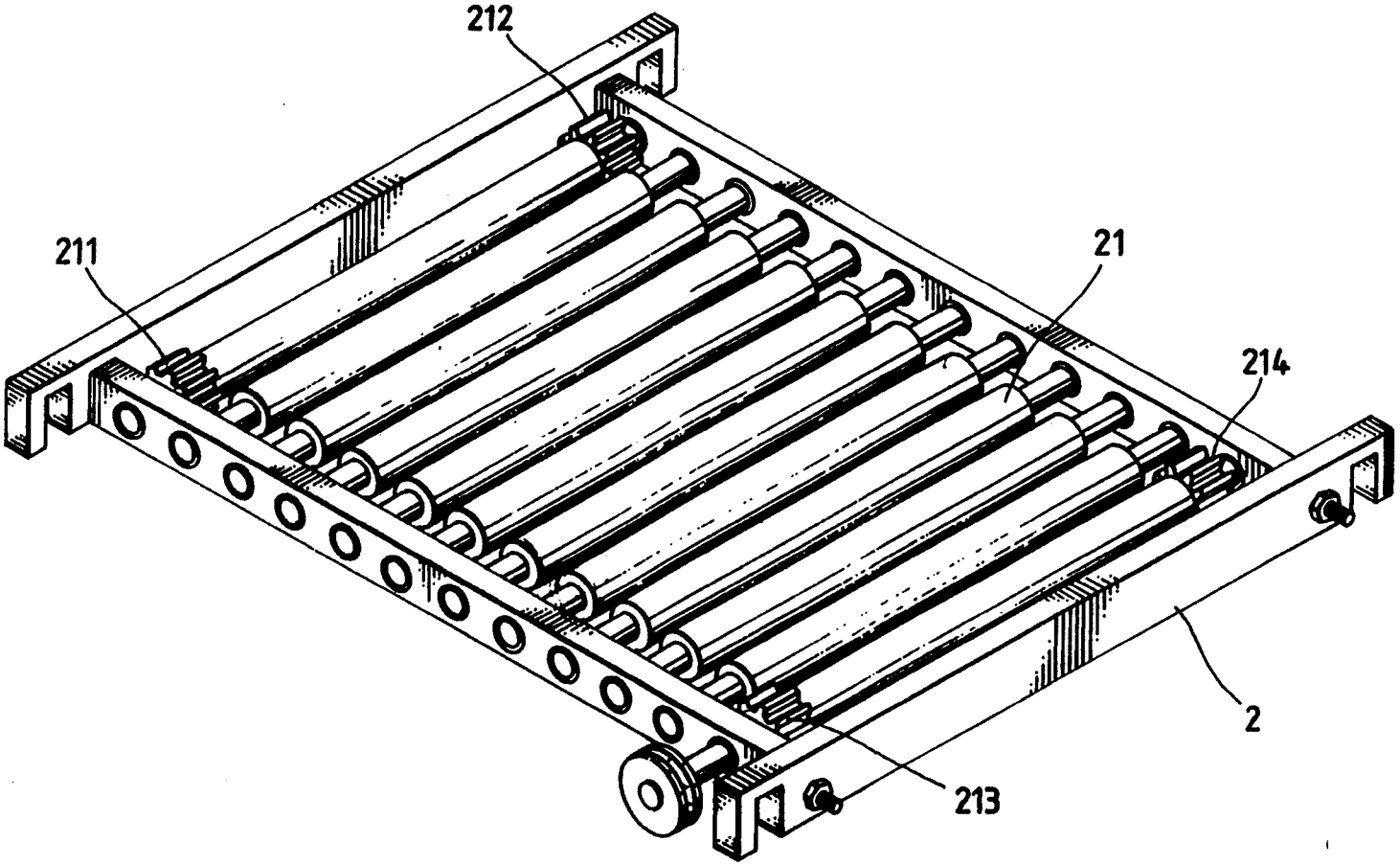
FIG. 2 is a perspective view of the track assembly of the baby walker when the endless belt removed.
Figure 3:
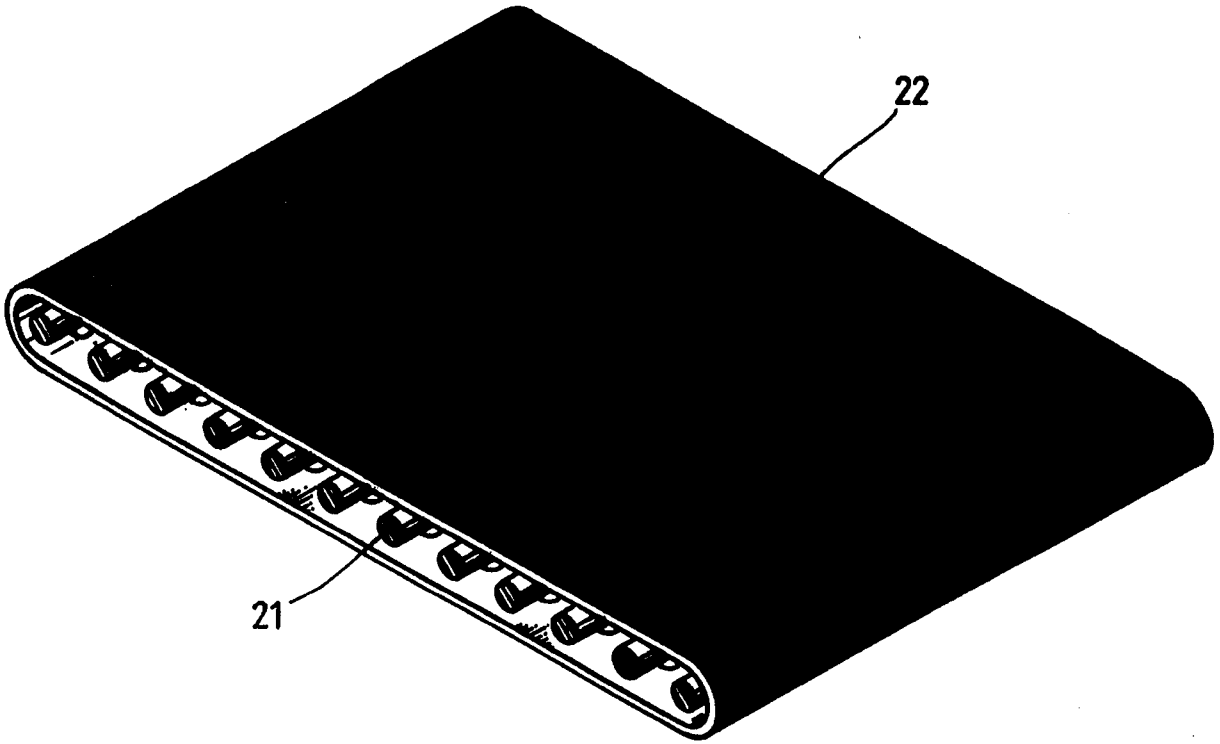
FIG. 3 is an elevational view of the track assembly.

Referring to FIGS. 1, 2 and 3, a baby walker in accordance with the present invention is generally comprised of a seat frame 3 supported on a hollow, rectangular, flat base 1 by a folding frame 4, a seat 32 mounted on the seat frame 3 to support a child learning to walk, and a track assembly 2 fastened within the flat base 1 for moving the baby walker on a flat surface. The track assembly 2 is comprised of a series of parallel rollers 21, and an endless belt 22 mounted around the parallel rollers 21. The endless belt 22 comprises a series of parallel teeth (not shown) transversely spaced around the inside wall thereof. Driving gears 211, 212, 213, 214 are respectively mounted on the two opposite ends of the first and last rollers 21 and engaged with the parallel teeth on the endless belt 22. As the child pushes the legs against the endless belt 22, the rollers 21 are turned to move the endless belt 22 in either direction, and therefore the baby walker is moved-forward or backward. A series of metal strings 33 are mounted on the seat frame 3 in front of the seat 32. A rotating shaft 31 is mounted on the seat frame 3 in front of the metal strings 33. The rotating shaft 31 is fastened with a plurality of striking hammers 34. Turning the rotating shaft 31 causes the striking hammers 34 to strike metal strings 33 in producing sounds.

Figure 4:
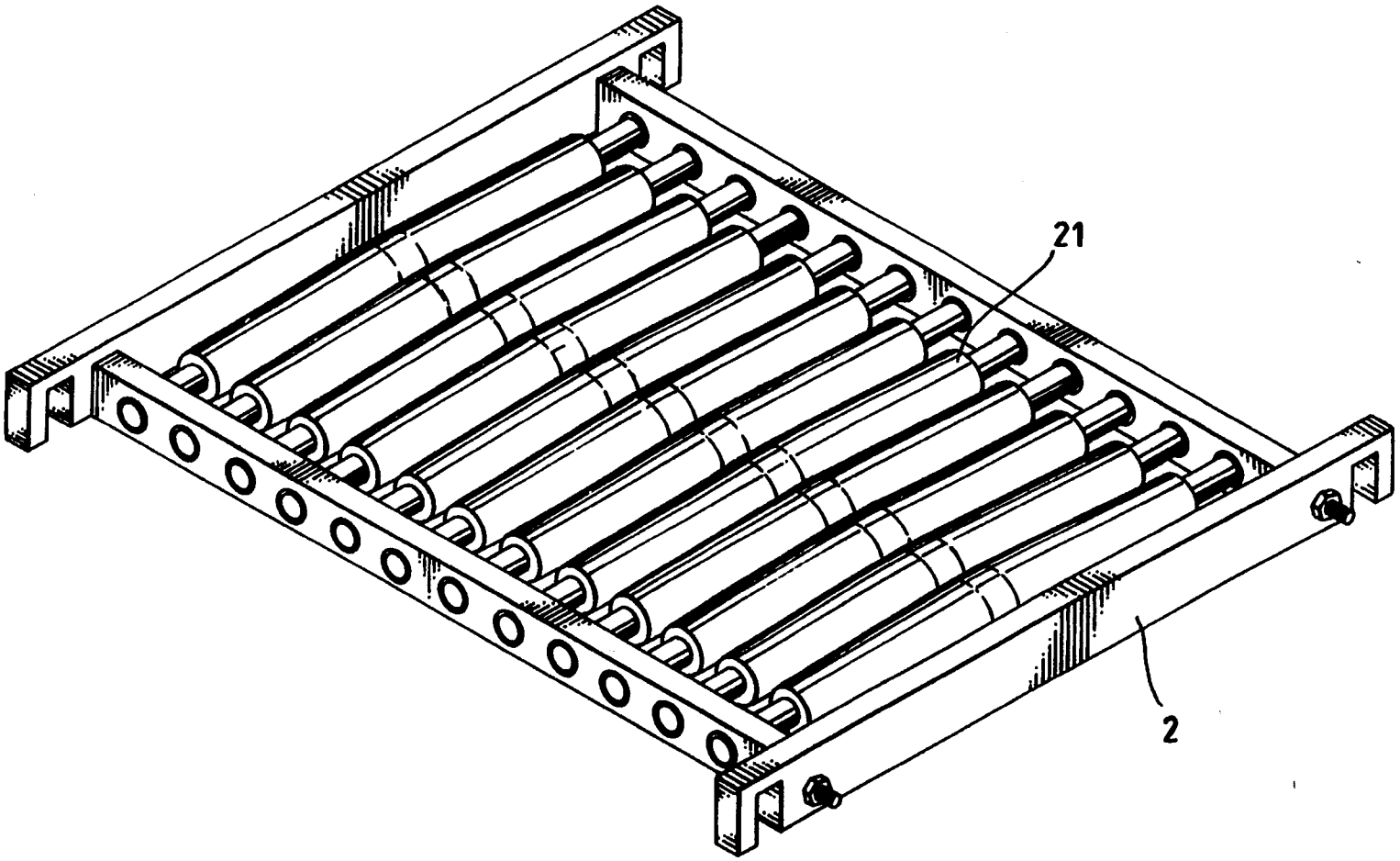
FIG. 4 illustrates an alternate form of the parallel rollers of the track assembly.
Figure 5:
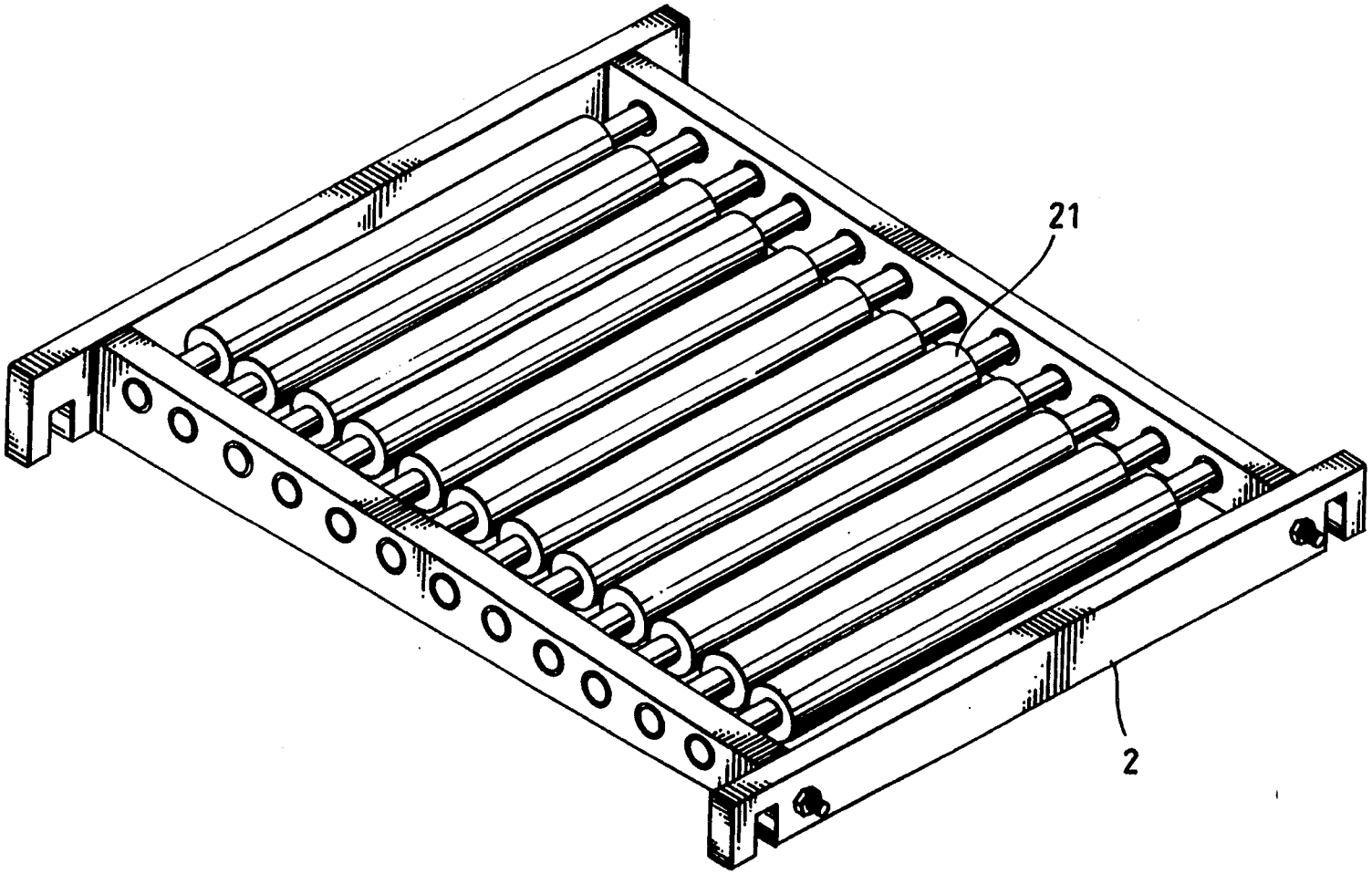
FIG. 5 illustrates another alternate form of the parallel rollers of the track assembly.

While only one embodiment of the present invention has been shown and described, it will be understood that various modifications and changes could be made without departing from the spirit and scope of the invention. For example, the rollers 21 may be made in either form shown in FIG. 4 or 5.

I claim:

1. A baby walker comprising a movable base, a seat frame and a folding frame arranged between said movable base and said seat frame, said seat frame holding a seat for supporting a child learning to walk; said movable base including an open frame, a series of parallel rollers arranged within a central opening of said open frame, and an endless belt mounted around said series of parallel rollers, said series of parallel rollers including first and last rollers and a plurality of intermediate rollers arranged between said first and last rollers, said first and last rollers each having a gear on two opposite ends thereof, said endless belt having a series of parallel teeth transversely spaced around an inside wall thereof engaging said gears of said first and second rollers, wherein said movable base is arranged so that rotation of said endless belt about said plurality of rollers moves said baby walker.

2. The baby walker according to claim 1, wherein a series of metal strings are mounted on said seat frame in front of said seat, and a rotating shalt is mounted on said seat frame in front of said series of metal strings, and said rotating shaft has a plurality of hammers, wherein rotating said rotating shaft causes said series of hammers to strike said metal strings for producing sounds.

* * * * *